US011305540B2

(12) United States Patent
Oltra Ramirez et al.

(10) Patent No.: US 11,305,540 B2
(45) Date of Patent: Apr. 19, 2022

(54) CLEANING PRINT HEAD CAP

(71) Applicant: HEWLETT-PACKARD DEVELOPMENT COMPANY, L.P., Spring, TX (US)

(72) Inventors: Ricardo Oltra Ramirez, Sant Cugat del Valles (ES); Lluis Sole Enrech, Sant Cugat del Valles (ES); Jose Angel Villasante Bembibre, Sant Cugat del Valles (ES); Jose Garcia Martinez, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/603,508

(22) PCT Filed: Jul. 20, 2018

(86) PCT No.: PCT/US2018/043151

§ 371 (c)(1),
(2) Date: Oct. 7, 2019

(87) PCT Pub. No.: WO2020/018119

PCT Pub. Date: Jan. 23, 2020

(65) Prior Publication Data

US 2021/0331477 A1 Oct. 28, 2021

(51) Int. Cl.
*B41J 2/165* (2006.01)
*B41J 2/175* (2006.01)

(52) U.S. Cl.
CPC ..... *B41J 2/16505* (2013.01); *B41J 2/16517* (2013.01); *B41J 2/17533* (2013.01); *B41J 2/17536* (2013.01)

(58) Field of Classification Search
CPC ..... B41J 2/16505; B41J 2/16517; B41J 2/17533; B41J 2/17536
See application file for complete search history.

(56) References Cited

U.S. PATENT DOCUMENTS

| | | | |
|---|---|---|---|
| 6,135,585 | A | 10/2000 | Johnson et al. |
| 6,402,288 | B2 | 6/2002 | Rhodes et al. |
| 6,637,857 | B2 | 10/2003 | Shimizu et al. |
| 6,916,080 | B2 | 7/2005 | Okamoto |

(Continued)

FOREIGN PATENT DOCUMENTS

EP 0 861 732 A2 * 9/1998 ..... B41J 2/175

*Primary Examiner* — Geoffrey S Mruk
(74) *Attorney, Agent, or Firm* — HP Inc. Patent Department

(57) ABSTRACT

A print head cap comprising a base element extending along a longitudinal direction and a first wall element extending along the longitudinal direction and connected to the base element. The base element comprises a cleaning element of a cleaning material on an inner side of the base element facing the first wall element. The first wall element comprises a first attachment element to removably attach the print head cap to a print head. The first attachment element allows removing the print head cap from the print head while the cleaning element remains in contact with the printing area of the print head by sliding the print head cap along the longitudinal direction, wherein the longitudinal direction is perpendicular to an ink depositing direction of the print head.

6 Claims, 6 Drawing Sheets

(56) References Cited

U.S. PATENT DOCUMENTS

| | | | |
|---|---|---|---|
| 7,380,902 | B2 | 6/2008 | Silverbrook et al. |
| 7,997,683 | B2 | 8/2011 | Mealy et al. |
| 8,104,869 | B2 | 1/2012 | Muhl et al. |
| 8,672,445 | B2 | 3/2014 | Wall et al. |
| 2002/0122092 | A1 | 9/2002 | Okamura et al. |
| 2011/0057990 | A1 | 3/2011 | Heo et al. |
| 2016/0221343 | A1 | 8/2016 | Brewster et al. |

* cited by examiner

CLEANING PRINT HEAD CAP

BACKGROUND

A print head that is provided for installation in a printing device, e.g., in a so-called "host unit", can undergo a pre-installation cleaning before its first use by a customer in order to ensure correct functionality of the print head and the printing device.

DETAILED DESCRIPTION

Figure 1A:
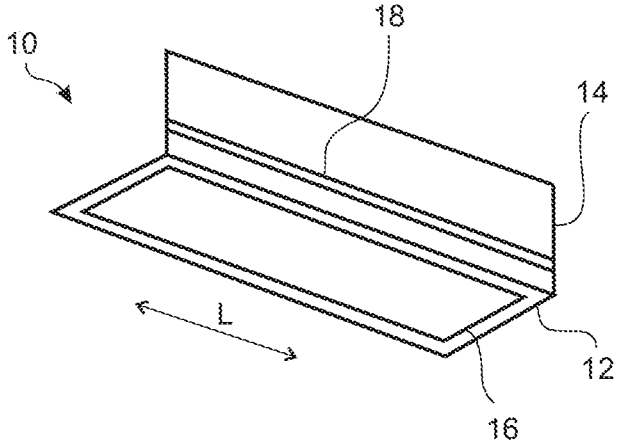
FIG. 1 is a schematic illustration of a print head cap according to an example. Different views thereof are shown in FIG. 1*a* and FIG. 1*b*.
Figure 1B:
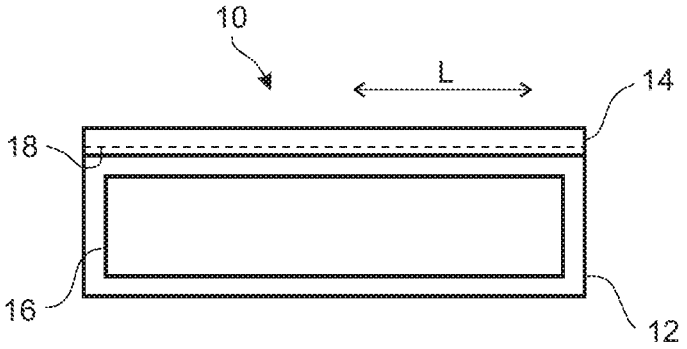

FIG. 1 is a schematic illustration of a print head cap 10 according to an example. FIG. 1*a* shows the print head cap 10 in a perspective view, whereas FIG. 1*b* shows a top view of the print head cap 10. The print head cap 10 comprises a base element 12 extending along a longitudinal direction indicated by arrow L in FIG. 1 and a first wall element 14 also extending along the longitudinal direction. The first wall element 14 is connected to the base element 12. In the example shown in FIG. 1, the base element 12 and the first wall element 14 are connected by a common edge that extends along the longitudinal direction, wherein the base element 12 and the first wall element 14 form a right angle. In some examples, the base element 12 and the first wall element 14 may be integrally formed.

The connection between the base element 12 and the first wall element 14 may however also have the form of a discontinuous material connection through connection elements or the like and hence not form a continuous edge. For instance, the base element 12 and the first wall element 14 may be connected by a plurality of L-shaped mechanical connection elements or be glued or welded together at a plurality of junction points. The base element 12 and the first wall element 14 may also form an acute angle or an obtuse angle depending on the geometry of the print head which the print head cap 10 is designed to be attached to.

The base element 12 comprises a cleaning element 16 of a cleaning material. The cleaning element 16 is provided on an inner side of the base element 12 facing the first wall element 14. The cleaning element 16 may extend over an entire length of the inner side of the base element 12 or over a part thereof. In the example shown in FIG. 1, the cleaning element 16 extends over substantially the entire length of the inner side of the base element 12.

Figure 3:
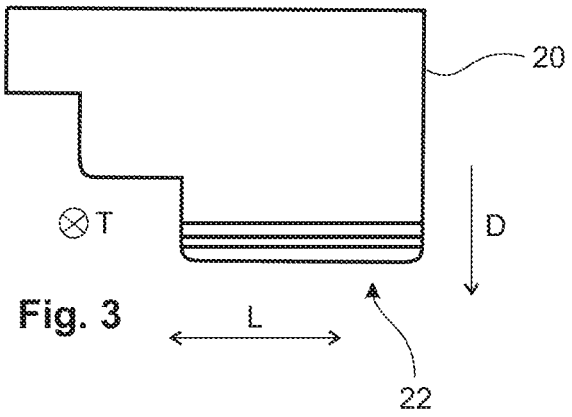
FIG. 3 is a schematic illustration of a print head according to an example.

The first wall element 14 comprises a first attachment element 18 to removably attach the print head cap 10 to a print head 20. A print head (not shown in FIG. 1) is shown in FIG. 3, which illustrates a print head 20 comprising a printing area 22 for ejecting ink or another printing fluid in an ink depositing direction. In FIG. 3, the ink depositing direction corresponds to a vertical downward direction, as illustrated by arrow D in FIG. 3. The printing area 22 may comprise printing nozzles to fire ink or another printing fluid stored inside the print head 20 into a printing medium. Printing nozzles may be arranged in the printing area 22 in rows and columns extending in the longitudinal direction, indicated by arrow L in FIG. 3 and in a transverse direction indicated by arrow T in FIG. 3. In some examples the longitudinal direction L may correspond to a direction in which a print media advances with respect to the print head 20 when printing.

In the example shown in FIG. 1, when the print head cap 10 is attached to the print head 20, the inner side of the base element 12 faces the printing area 22 of the print head 20 such that the cleaning element 16 of the print head cap 10 covers the printing area 22 and the cleaning element 16 is in contact with the printing area 22. The first attachment element 18 allows removably attaching the print head cap 10 to the print head 20 and removing the print head cap 10 from the print head 20 while at least a part of the cleaning element 16 remains in contact with at least a part of the printing area 22 of the print head 20 by sliding the print head cap 10 along the longitudinal direction with respect the print head 20. In fact, the first attachment element can be such that it limits removing the print head cap 10 from the print head 20 to removing by a sliding movement and inhibits removing the print head cap in another direction than the longitudinal direction. The longitudinal direction L is substantially perpendicular to the ink depositing direction (cf. direction D in FIGS. 3 and 4) of the print head 20, i.e. to a direction in which ink or another printing fluid is ejected through the printing area 22 of the print head 20 towards a printing medium, like a paper.

The cleaning element 16 may vertically protrude from the base element 12 towards the inner side thereof such that, when the print head cap 10 is attached to the print head 20 and when the print head cap 10 is removed or detached from the print head 20, a part of the base element 12 that is in contact with the printing area 22 of the print head 20 and may slide against the printing area 22 is the cleaning element 16. Other parts of the base element 12, like edge parts thereof surrounding the cleaning element 16, may be not in contact with the printing area 22, which may avoid damaging the printing area 22 of the print head 20. The geometry of the cleaning element 16 may be such as to match a corresponding geometry of the printing area 22 of the print head 20. For example, if the print head cap 10 is designed to cover a print head 20 having a rectangular printing area 22 of given dimensions, the cleaning element may also have a corresponding rectangular shape and said given dimensions. In some examples, the cleaning element 16 may completely cover the inner side of the base element 12.

In some examples the first attachment element 18 may comprise a groove extending on the first wall element 14 of the print head cap 10 along the longitudinal direction. The groove may indent into an inner side of the first wall element 14 that faces the base element 12. In that case, the first attachment element 18 may be suitable to removably attach the print head cap 10 to a print head by receiving a protrusion formed in the print head. The protrusion of the print head 20 may correspond to a protruding edge that is present in some models of print head 20.

Additionally or alternatively, the first attachment element 18 may comprise a protrusion extending on the first wall element 14 of the print head cap 10 along the longitudinal direction. The protrusion may protrude from the first wall element 14 from the aforementioned inner side thereof. In that case the first attachment element 18 may be suitable to removably attach the print head cap 10 to a print head by fitting into a groove formed in the print head.

The first attachment element 18 may also comprise other types of attachment element, for example a magnetic element or a plurality of magnetic elements to create a magnetic removable connection between the print head cap 10 and a print head 20, or any combination of different types of attachment element. The first attachment element 18 may for instance comprise a groove and a protrusion, wherein the first attachment element 18 is formed as a groove for a part of its extension and as a protrusion for another part of its extension.

The first attachment element 18 allows removably attaching the print head cap 10 to the print head 20 in such a way that the print head cap 10 may be removed from the print head 20 by sliding along the longitudinal direction, which in the figures corresponds to a horizontal direction, while at least a part of the cleaning element 16 remains in contact with at least a part of the printing area 22 of the print head 20. The cleaning element 16 slides against the printing area 22 during the removal. The first attachment element 18 guides the sliding movement along the longitudinal direction and holds the cleaning element 16 in contact with the printing area 22 during the aforesaid sliding movement. The first attachment element 18 may contribute to avoiding uncontrolled displacements or rotations of the print head cap 10 with respect to the print head 20 during the sliding movement for removal. Further, the first attachment element may prevent the base element 12 to bend away from the print head 20 in order to ensure that the cleaning element 16 remains in contact with the printing area 22 during the entire removal movement of the print head cap 10. Thus, the first attachment element 18 ensures an optimal contact between the cleaning element 16 and the printing area 22 of the print head 20 during removal and hence an increased cleaning efficiency.

The operation of removing the print head cap 10 from the print head 20 needs not be carried out overly carefully or according to any particular technique or instructions. Thanks to the guidance provided by the first attachment element 18, any user may manually remove the print head cap 10 from a print head 20 without any risk of negatively affecting the quality of cleaning or damaging the print head 20 or components thereof, like for example nozzles present in the printing area 22. The precise configuration of the print head cap 10, like for example the configuration of the cleaning element 16 and of the first attachment element 18 allows configuring the cleaning process in a deterministic manner.

The simple structure of the print head cap 10 allows easily adapting existing print head caps and existing print heads for implementing the teachings of the present disclosure without having to substantially differ from pre-existing designs and manufacturing processes, in order to provide a print head cap according to this disclosure, which does not just offer protection for the printing area 22 of the print head 20 but further allows for a very easy and user-friendly pre-installation cleaning of the printing area 22.

Notably, the print head cap 10 also allows for post-installation cleaning. For example, a user wishing to protect a print head after its first use for storing or shipping the print head may use the print head cap 10. When the print head cap 10 is removed from the print head 20 at a later time, the cleaning process is automatically carried out, such that a proper functioning of the print head 20 can be ensured even if the print head 20 has not been used for a long time, for example after being stored or shipped for a long time. The print head cap 10 may also be reused.

The cleaning material of the cleaning element 16 may be any material having physical properties making it suitable for protecting the printing area 22 and for cleaning the printing area 22 of the print head by sliding it against it. In some examples, this functionality of the cleaning material may be achieved through any combination of its thickness, rigidness, stiffness, elasticity and any physical property governing the friction behavior of the cleaning material when sliding against the printing area 22, like, for example, the material composition. In some examples, the cleaning material may comprise an ethylene propylene diene monomer rubber (EPDM), a thermoplastic, like any of polyethylene terephthalate (PET) or polyamide 6 (PA6), or any combination thereof.

The cleaning material may further be or comprise a fibrous material. For example, the cleaning material may comprise PET fibers and PA6 fibers, wherein the cleaning material may be obtained by compressing and calendaring the PET fibres and the PA6 fibres. This may allow adjusting the thickness of the cleaning material and achieving a softer cleaning material. The cleaning material may also be obtained by directly stapling PET fibers and PA6 fibers manufactured to meet predefined thickness and softness. The cleaning material may also comprise a non-woven material, such as a fleece or hairy material, a porous material, like foam, a spongy material, or a combination thereof.

The material choice for the remaining structural components of the print head cap 10, namely the base element 12, the first wall element 14, and any other further wall elements, like the second and third wall elements defined below, may also improve the functionality of the print head cap 10. For example, any or both of the base element 12 and the first wall element 14 (and, additionally or alternatively, any or both of the second and third wall elements described below) may be of a material, like a plastic or metallic material, having a rigidity or stiffness such as to prevent the print head cap 10 from bending when a force is exerted upon the print head cap 10 to remove the print head cap 10 from the print head 20 independently of whether that force is or not correctly aligned with the longitudinal direction. In particular, the aforesaid rigidity or stiffness may be such as to prevent the base element 12 from bending in a way causing the cleaning element 16 to loose contact with the printing area 22 of the print head 20. For example, any or both of the base element 12 and the first wall element 14 (and, additionally or alternatively, any or both of the second and third wall elements 15, 17) may comprise a thermoplastic, for example a polypropylene. Any or both of the base element 12 and the first wall element 14 (and, additionally or alternatively, any or both of the second and third wall elements 15, 17) may comprise a material equal to the cleaning material. However, any or both of the base element 12 and the first wall element 14 (and, additionally or alternatively, any or both of the second and third wall elements 15, 17) may be of a material different to the cleaning material.

Figure 2A:
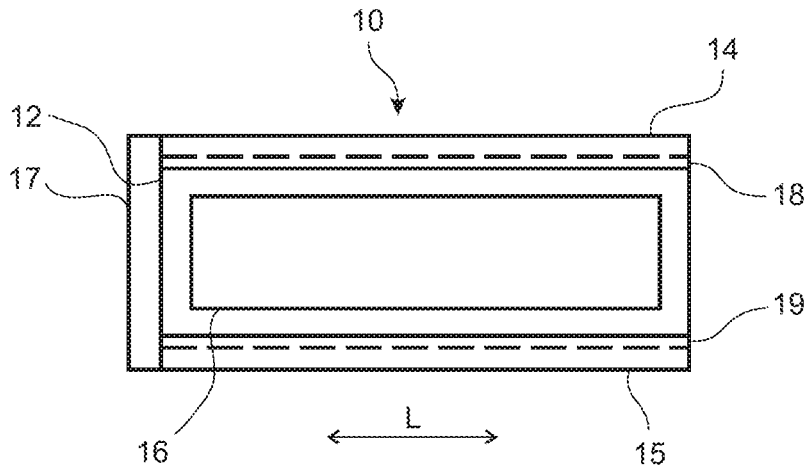
FIG. 2 is a schematic illustration of a print head cap according to another example. Different views thereof are shown in FIG. 2*a* and FIG. 2*b*.
Figure 2B:
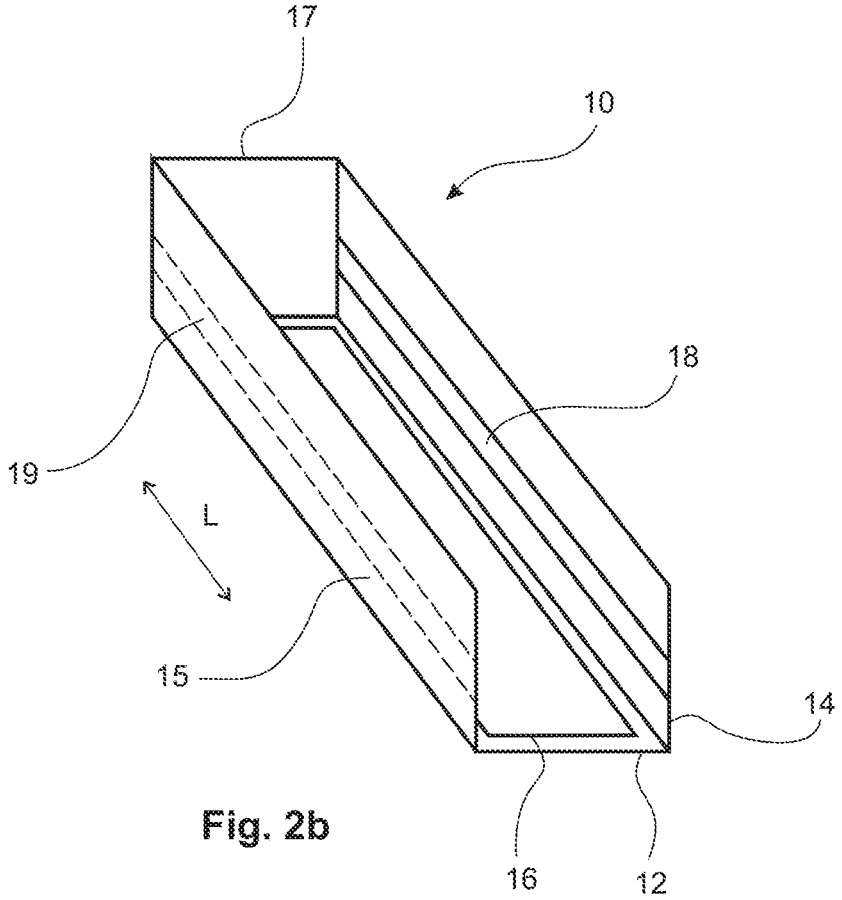

FIG. 2 is a schematic illustration of a print head cap 10 according to another example. FIG. 2*a* shows the print head cap 10 in a perspective view, whereas FIG. 2*b* shows a top view of the print head cap 10. The print head cap 10 of FIG. 2 comprises all elements comprised in the example shown in FIG. 1 and further comprises a second wall element 15 extending along the longitudinal direction and connected to the base element 12 and a third wall element 17 connected to the first and second wall elements 14, 15 and to the base element 12. The longitudinal direction is indicated in FIG. 2 by an arrow L.

In the example shown in FIG. 2, the first, second, and third wall elements 14, 15, and 17 all have the same height over the base element 12. In other examples, however, the first, second, and third wall elements 14, 15, and 17 may each have different heights over the base element 12. For instance, the third wall element 17 may have a larger height over the base element 12 than any or both of the first and second wall elements 14 and 15. Print head caps 10 like that shown in FIG. 2 comprising a second wall element 15 but no third wall element 17 are also included in the present disclosure, as well as print head caps 10 comprising a third wall element 17 but no second wall element 17. In examples comprising no third wall element 17, the print head cap 10 may slide with respect to the print head 20 in order to removably attach the print head cap 10 to the print head 20 or to remove the print head cap 10 from the print head 20 along the longitudinal direction bidirectionally, i.e. both leftwards and rightwards along the longitudinal direction L as shown in the figures.

The second wall element 15 extends opposite to the first wall element 14, such that the base element 12 extends between the first wall element 14 and the second wall element 15. The third wall element 17 extends perpendicular to the longitudinal direction and perpendicular to any or both of the first and second wall elements 14 and 15 and may have common edges with each of the first and second wall elements 14 and 15 and with the base element 12. An angle between the third wall element 17 and the base element 12 may also be a right angle, an acute angle or an obtuse angle and may be configured to adapt to the form of the print head 20 such that the third wall element 17 is flush with the print head 20 when the print head cap 10 is attached to the print head 20 and the cleaning element 16 completely covers the printing area 22 of the print head 20. However, in other examples, the cleaning element 16 may partly cover the printing area 22 or may not cover the printing area 22.

The second and third wall elements 15 and 17 may be connected to the base element 12 in the same ways described for the connection between the first wall element 14 and the base element 12. The second wall element 15 may be angled with respect to the base element 12 the same manner in which the first wall element 14 is angled with respect to the base element 12. For example, if the first wall element forms a right angle with the base element 12, the second wall element 15 may also form a right angle with the base element, such that the first wall element 14 and the second wall element 15 extend mutually parallel and perpendicular to the base element 12.

The second wall element 15 may comprise a second attachment element 19 that is functionally analogous to the first attachment element 18 of the first wall element 14. However, examples in which the second wall element 15 does not comprise a second attachment element 19 are also included in the present disclosure. The second attachment element 19 may provide, in combination with the first attachment element 18, a more stable removable connection between the print head cap 10 and a print head 20 and a better control over the sliding movement for removing the print head cap 10 from the print head 20.

The second attachment element 19 may or may not be of the same type as the first attachment element 18. For example, the first attachment element 14 may comprise a groove and the second attachment element 19 may comprise a protrusion. Additionally or alternatively, the first attachment element 18 may comprise a protrusion and the second attachment element 19 may comprise a groove. In some examples, the first and second attachment elements 18 and 19 may both comprise a protrusion or a groove extending along the longitudinal direction. In some examples, each of the first and second attachment elements 18 and 19 may comprise a groove for some part of its extension along the longitudinal direction and a protrusion for some other part of its extension along the longitudinal direction.

The first and second attachment elements 18 and 19 may respectively extend in the longitudinal direction throughout the length of the first and second wall elements 14 and 15 or a part thereof. In some examples, the first and second attachment elements 18 and 19 may be located at a same vertical distance from the base element 12, such that the first and second attachment elements 18 and 19 are disposed opposed and parallel to each other. In other examples, the vertical distance between the first attachment element 18 and the base element 12 may be different to a vertical distance between the second attachment element 19 and the base element 12.

Figure 4:
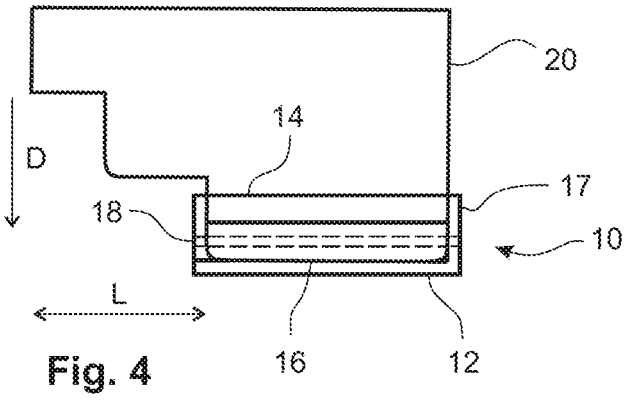
FIG. 4 is a schematic illustration of a printing system according to an example.

FIG. 4 is a schematic illustration of a printing system according to an example comprising a print head cap 10 and a print head 20. In the example shown in FIG. 4, the print head cap 10 is removably attached to the print head 20 such that the print head cap 10 protects the printing area 22 of the print head 20. The print head cap 10 may correspond to any of the examples described above. The print head 20 may correspond to the print head 20 described with reference to FIG. 3. The print head cap 10 is removably attachable to the print head 20 using the first attachment element 18 described above to removably attach the print head cap 10 to the print head 20. In the example shown in FIG. 4, when the print head cap 10 is attached to the print head 20, the cleaning element 16 of the print head cap 10 covers the printing area 22 of the print head 20 and the cleaning element 16 is in contact with the printing area 22. The longitudinal direction and the ink depositing direction are respectively indicated in FIG. 4 by an arrow L and an arrow D.

In the example shown in FIG. 4, the first attachment element 18 comprises a groove formed in the first wall element 14 extending along the longitudinal direction and a protrusion (not shown) formed in the print head 20 also extending along a longitudinal direction. The longitudinal direction corresponds to the longitudinal direction defined above with respect to FIG. 1 to 3.

The print head cap 10 of FIG. 4 can be removably attached to the print head 20 by fitting the protrusion formed in the print head 20 into the groove formed in the first wall element 14. For example, the print head cap 10 can be attached to the print head by longitudinally, i.e. along the longitudinal direction, sliding the protrusion into the groove such that the print head cap 10 longitudinally slides with respect to the print head 20 until the printing area 22 of the print head 20 is fully covered by the cleaning element 16 of the print head cap 10.

In the example shown in FIG. 4, this may be achieved by longitudinally sliding the print head cap 10 against the print head 20 using the first attachment element 18, i.e. the aforesaid groove and protrusion, until a third wall element 17 of the print head cap 10 contacts the print head 20. Alternatively, the print head cap 10 can be attached to the print head by laterally, i.e. in a direction perpendicular to the longitudinal direction and to the ink depositing direction, introducing the protrusion into the groove such that the print head cap be laterally attached to the print head 20. The material composition of the print head cap 10 may be such as to allow for some degree of elastic deformability, i.e. for some variability in an angle between the base element 12 and any of the first and second wall elements 14 and 15 in order to ease this manner of laterally attaching the print head cap 10 to the print head 20.

In other examples, the first attachment element 18 may comprise a protrusion formed in the first wall element 14 extending along a longitudinal direction and a groove formed in the print head 20 also extending along a longitudinal direction. The working principle of the first attachment element 18 remains the same in that case as in the example previously described. Notably, although the first attachment element 18 is described herein with respect to the printing system shown in FIG. 4, all details provided with respect to the first attachment element 18 may also apply to a second attachment element 19 included in the print head cap 10 as described above.

In some examples, the first attachment element 18 is configured to control or limit a sliding velocity achievable by the print head cap 10 when the print head cap is removed from the print head 20. For example, a material composition of the first attachment element 18 may be configured such that a friction coefficient between the print head cap 10 and the print head 20 be such that the velocity achievable by the print head cap 10 when manually removing the print head cap 20 from the print head 20 does not exceed a predefined limit velocity. This may contribute to ensuring that the cleaning of the printing area 22 by the cleaning element 16 of the print head cap 10 is performed correctly.

In the example shown in FIG. 4, the print head cap 10 has a length, i.e. an extension along the longitudinal direction, greater than a length of the printing area 22 of the print head cap 20 along the longitudinal direction, such that the cleaning element 16 extends along the longitudinal direction for a length greater than the length of the printing area 22 of the print head 20 along the longitudinal direction. The print head cap 10 can be removed from the print head 20 by sliding in the longitudinal direction L, which in FIG. 4 corresponds to the horizontal direction, by means of the first attachment element 18 and any other attachment element present, like the second attachment element 19 described above. During the removal, the cleaning element 16 of the print head cap 10 remains in contact with the printing area 22 of the print head 20 and slides against the printing area 22 thereby implementing a cleaning operation of the printing area 22 such that the print head 20 be ready for use. In the example shown in FIG. 5, the print head cap 10 has a length, i.e. an extension along the longitudinal direction, greater than twice the length of the printing area 22 of the print head 20, such that the cleaning element 16 extends along the longitudinal direction for a length $l_2$ longer than at least twice the length $l_1$ of the printing area 22 of the print head 20 along the longitudinal direction (i.e. $l_2>2\ l_2$). In that way, the surface of cleaning element 16 involved in the cleaning when the print head cap 10 is removed from the print head 20 can be at least be twice as large as in the example shown in FIG. 4, which may allow for a better cleaning of the printing area 22.

Figure 5:
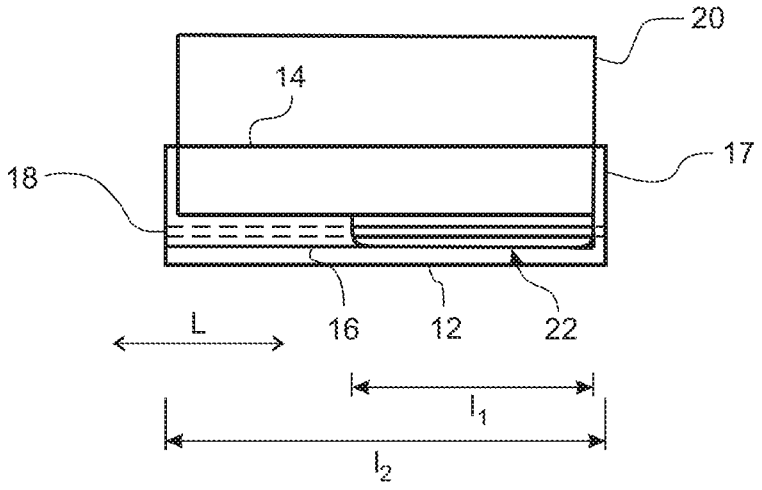
FIG. 5 is a schematic illustration of a printing system according to another example.

Other ratios of the length $l_2$ of the cleaning element 16 and the length $l_1$ of the printing area 22 than those described with respect to FIGS. 4 and 5 are also included in the present disclosure. In particular, the length $l_2$ of the cleaning element 16 may be chosen to be sufficiently greater than the length $l_1$ of the printing area 22 to ensure a desired degree of cleaning of the printing area 22, wherein a degree of cleaning may correspond to a predefined total surface of the cleaning element 16 that is made to slide against the printing area 22 when removing the print head cap 10 from the print head 22.

In some examples, the length $l_2$ of the cleaning element 16 also may be shorter than the length $l_1$ of the printing area 22, provided that there is a sufficient length of relative movement between the cleaning element 16 and the printing area 22. A sufficient length of relative movement between the cleaning element 16 and the printing area 22 may be provided by a corresponding sufficient length of the first attachment element 18. In different examples, the length $l_2$ of the cleaning element 16 may be between 0.25 and 3 times the length $l_1$ of the printing area 22, such as about 0.5, 0.75, 1, 1.25, 1.5, 1.75, 2, 2.25, 2, or 2.5 times the length $l_1$.

Figure 6:
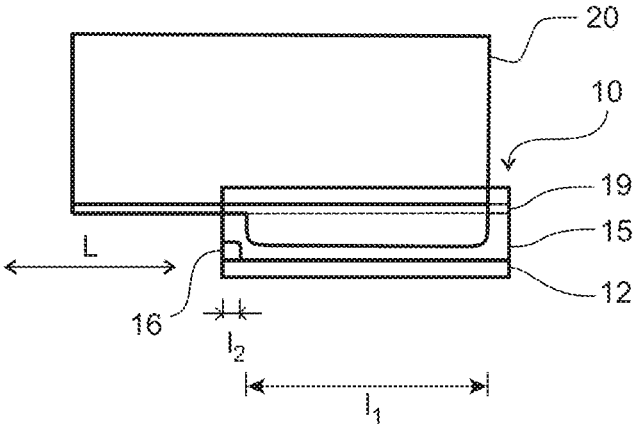
FIG. 6 is a schematic illustration of a printing system according to another example.
Figure 7:
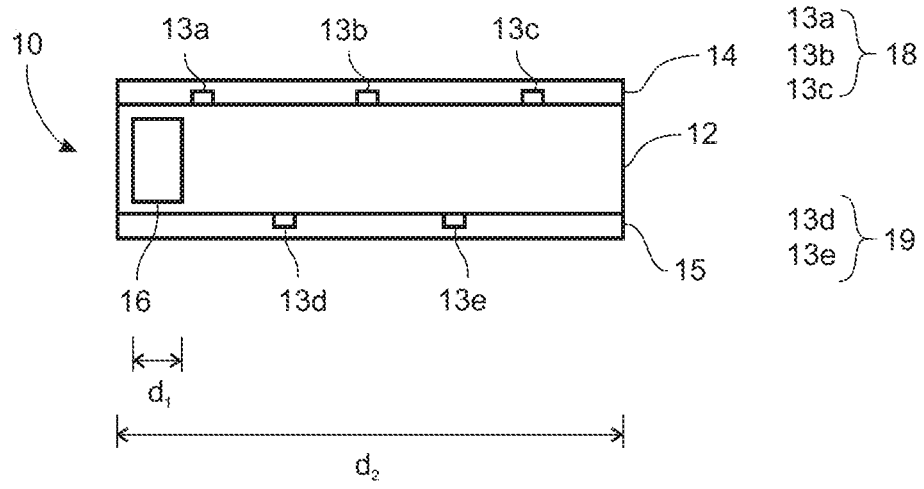
FIG. 7 is a schematic illustration of a print head cap according to another example.

FIG. 6 shows an example of a printing system in which the cleaning element 16 of the print head cap 10 extends in the longitudinal direction L for a length $l_2$ shorter than the length $l_1$ of the printing area 22 ($l_2<l_1$). The print head cap 10 used in the example shown in FIG. 6 is shown in FIG. 7. In the print head cap 10 shown in FIG. 7, the cleaning element 16 extends for a length $d_1$ over a part of the entire length $d_2$ of the inner side of the base element 12 along the longitudinal direction L, wherein $d_1<d_2$. The print head cap 10 shown in FIG. 7 has the same components as the print head cap 10 shown in FIG. 2*a* except for the different extension of the cleaning element 16 along the longitudinal direction L and for the absence of a third wall element 17. Further, in the example shown in FIG. 7, the first attachment means 18 of the first wall element 14 comprises a plurality of magnetic elements 13*a*, 13*b*, and 13*c*, and the second attachment means 19 of the second wall element 15 comprises a plurality of magnetic elements 13*d* and 13*e*. The magnetic elements 13*a*-13*e* form a magnetic removable connection between the print head cap 10 and a print head 20.

Thus, the cleaning element 16 of the print head cap 10 may have an extension along the longitudinal direction shorter than an extension along the longitudinal direction of the inner side of the base element 12. Further, the cleaning element 16 may be located at one end portion of the inner side of the base element 12. In the example shown in FIG. 7, the cleaning element 16 is located at the left (as shown in the figure) end portion of the inner side of the base element 12. When the print head cap 10 shown in FIG. 7 is attached to a printhead 20, as shown in FIG. 6, the print head cap 10 may be removed along the longitudinal direction rightwards (as shown in the figure), such that the cleaning element 16 slides against the printing area 22. The first and second attachment means 18 and 19 allow removing the print head cap 10 from the print head 20 such that the cleaning element 16 sweeps an entire surface of the printing area 22 or at least a significant part thereof.

A further difference with respect to the examples of FIGS. 2*a*, 2*b*, and 4 is that, as shown also in FIG. 6, in the example of a print head cap 10 shown in FIG. 7, when the print head cap 10 is attached to the print head 20, the cleaning element 16 does not cover the printing area 22. Instead, the cleaning element 16 is laterally separated from the printing area 22 in the longitudinal direction L. In other examples, when the print head cap 10 is attached to the print head 20, the cleaning element 16 may cover a part of the printing area 22 and may be in contact with the aforesaid part of the printing area 22.

Figure 8:
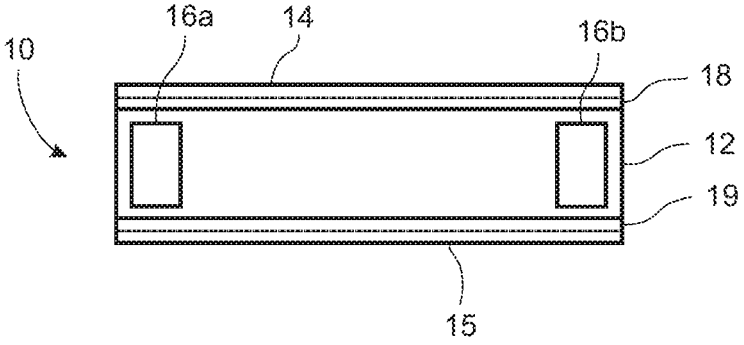
FIG. 8 is a schematic illustration of a print head cap according to another example.

FIG. 8 shows an example of a print head cap 10 similar to the print head cap shown in FIG. 7. The print head cap 10 of FIG. 8 differs from the print head cap shown in FIG. 7 by the fact that instead of a single cleaning element 16, the print head cap 10 comprises a first cleaning element 16*a* located at a left (as shown in the figure) end portion of the inner side of the base element 12 and a second cleaning element 16*b* located at a right (as shown in the figure) end portion of the inner side of the base element 12. Each of the first and second cleaning elements 16*a* and 16*b* extends in the longitudinal direction L for a length shorter than an extension in the longitudinal direction of the inner face of the base element 12. Further, the first and second attachment means 18 and 19 correspond to those of the example shown in FIG. 2.

When the print head cap 10 of FIG. 8 is attached to a print head 20, each of the first and second cleaning elements 16*a* and 16*b* may or may not cover and be in contact with the printing area 22 of the print head 20. Further, the print head cap 10 may be removed along the longitudinal direction bidirectionally, i.e. rightwards or leftwards, since either way one of the first and second cleaning elements 16*a* or 16*b* may slide against the printing area 22 and may sweep an entire surface of the printing area 22 or at least a significant part thereof.

Figure 9:
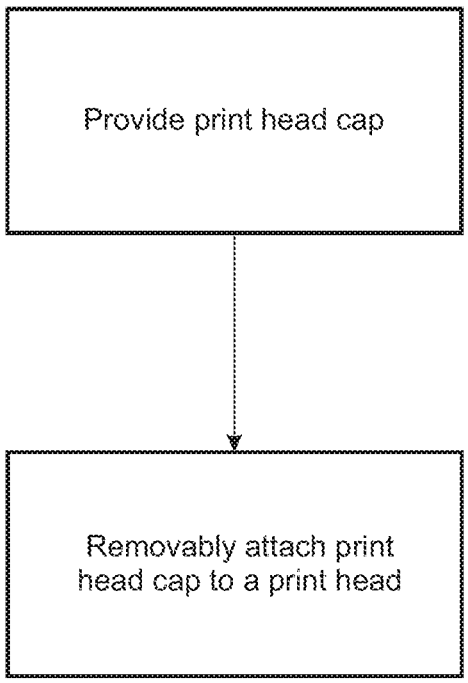
FIG. 9 is a flow diagram representing a method of preparing a print head for pre-installation print head cleaning according to an example.

A further aspect of the present disclosure refers to a method of preparing a print head for pre-installation cleaning using a print head cap. The method, which is illustrated in FIG. 9, comprises providing a print head cap 10 according to any of the examples described above and removably attaching the print head cap 10 to a print head 20 using the first attachment element 18. This method may be used for preparing the print head 20 for pre-installation or pre-use cleaning using the print head cap 10 before providing the print head 20 to a user, such that the user receives a printing system similar to that shown in FIG. 4 or that shown in FIG. 6 comprising a print head 20 and a print head cap 10 removably attached to the print head 20. Once the user receives the printing system, the user may easily, even unknowingly, perform pre-installation cleaning of the printing area 22 of the print head 20 by removing the print head cap 10 from the print head 20.

The method may be performed by a manufacturer of the print head 20 upon manufacturing of the print head 20 or subsequently by a provider of the print head before the print head is shipped or delivered to a customer or user.

Specific examples of a print head cap, a printing system and a method of preparing a print head for pre-installation cleaning according to the present disclosure have been described herein in greater detail with reference to FIGS. 1 to 9. However, the description of the examples in the figures merely serves to illustrate the disclosure and should not be construed to imply any limitation. The scope of the disclosure is to be determined based on the appended claims.

The invention claimed is:

1. A print head cap comprising:

a base element extending along a longitudinal direction;

a first wall element extending along the longitudinal direction and connected to the base element;

wherein the base element comprises a cleaning element of a cleaning material on an inner side of the base element facing the first wall element;

wherein the first wall element comprises a first attachment element that is adapted to removably attach the print head cap to a print head, wherein the first attachment element is further adapted to guide a sliding movement of the print head cap along the longitudinal direction with respect to the printing head during a removal movement of the print head cap while maintaining the cleaning element in sliding engagement with a printing area of the print head during the removal movement, and wherein the longitudinal direction is perpendicular to an ink depositing direction of the print head.

2. The print head cap of claim 1, wherein the first attachment element comprises any of a groove and a protrusion extending along the longitudinal direction.

3. The print head cap of claim 1, wherein the cleaning material comprises any of a thermoplastic, an ethylene propylene diene monomer rubber, or a combination thereof.

4. The print head cap of claim 1, further comprising a second wall element extending along the longitudinal direction and connected to the base element; wherein the second wall element extends opposite and parallel to the first wall element such that the base element extends between the first wall element and the second wall element.

5. The print head cap of claim 4, wherein the second wall element comprises a second attachment element that is adapted to removably attach the print head cap to the print head; and wherein the first and second attachment elements allow removing the print head cap from the print head by sliding the print head cap along the longitudinal direction.

6. The print head cap of claim 5, further comprising a third wall element extending perpendicular to the longitudinal direction and connected to the base element, wherein the third wall element extends perpendicular to any or both of the first and second wall elements such that the base element extends between the third wall element and said any or both of the first and second wall elements.

* * * * *